US009561421B2

(12) United States Patent
Hungelmann

(10) Patent No.: US 9,561,421 B2
(45) Date of Patent: Feb. 7, 2017

(54) SPORTS TRAINING AND CONDITIONING APPARATUS RELATING TO GOLF

(71) Applicant: James Hungelmann, Ketchum, ID (US)

(72) Inventor: James Hungelmann, Ketchum, ID (US)

( * ) Notice: Subject to any disclaimer, the term of this patent is extended or adjusted under 35 U.S.C. 154(b) by 0 days.

(21) Appl. No.: 14/871,644

(22) Filed: Sep. 30, 2015

(65) Prior Publication Data

US 2016/0089590 A1 Mar. 31, 2016

Related U.S. Application Data

(60) Provisional application No. 62/057,673, filed on Sep. 30, 2014.

(51) Int. Cl.

| | |
|---|---|
| ***A63B 69/36*** | (2006.01) |
| ***A63B 69/00*** | (2006.01) |
| *A63B 21/02* | (2006.01) |
| *A63B 21/045* | (2006.01) |
| *A63B 21/06* | (2006.01) |
| *A63B 71/06* | (2006.01) |

(52) U.S. Cl.

CPC ..... *A63B 69/36* (2013.01); *A63B 69/0057* (2013.01); *A63B 69/3644* (2013.01); *A63B 21/023* (2013.01); *A63B 21/045* (2013.01); *A63B 21/06* (2013.01); *A63B 21/4005* (2015.10); *A63B 21/4009* (2015.10); *A63B 21/4015* (2015.10); *A63B 21/4035* (2015.10); *A63B 2071/0638* (2013.01); *A63B 2208/0204* (2013.01); *A63B 2225/09* (2013.01); *A63B 2225/093* (2013.01)

(58) Field of Classification Search

USPC ..... 473/208, 215, 216, 222, 229, 257, 258,473/271, 274, 275, 276

See application file for complete search history.

(56) References Cited

U.S. PATENT DOCUMENTS

| | | | | |
|---|---|---|---|---|
| 1,399,761 | A * | 12/1921 | Garland | A63B 69/3644 473/258 |
| 1,633,527 | A | 6/1927 | Hansen | |
| 1,634,102 | A | 6/1927 | Hansen | |
| 1,670,409 | A | 5/1928 | Hansen | |
| 1,960,787 | A | 5/1934 | Macstocker | |
| 2,611,610 | A * | 9/1952 | Rikuo | A63B 69/0059 473/257 |
| 2,653,025 | A | 9/1953 | Zega | |
| 2,813,721 | A | 11/1957 | Zega | |
| 2,868,543 | A | 1/1959 | Zega | |
| 3,339,927 | A | 9/1967 | Nunn | |

(Continued)

FOREIGN PATENT DOCUMENTS

| | | |
|---|---|---|
| EP | 0312287 | 4/1989 |
| GB | 227725 | 1/1926 |

(Continued)

*Primary Examiner* — Nini LeGesse

(74) *Attorney, Agent, or Firm* — Parsons Behle & Latimer

(57) ABSTRACT

Disclosed embodiments include a swing training apparatus for use in sports, like golf, baseball, tennis, bowling, or the like where the swinging of an arm, a club, bat or racket is part of the sport. Embodiments of the apparatus include a base, foot receptacles, a torso stabilizer, a swing channel, and a shaft. In disclosed embodiments, the user attaches himself or herself to the torso stabilizer and grasps the shaft. The shaft may be confined to travel along the swing channel and thereby trains the user to swing with the proper motion.

18 Claims, 4 Drawing Sheets

(56) References Cited

U.S. PATENT DOCUMENTS

| | | | | | |
|---|---|---|---|---|---|
| 3,489,416 | A | | 1/1970 | Mark | |
| 3,711,103 | A | * | 1/1973 | Seltzer | A63B 69/3644 473/229 |
| 3,730,531 | A | | 5/1973 | Zega | |
| 4,280,701 | A | | 7/1981 | Beckish | |
| 4,318,546 | A | * | 3/1982 | Chen | A63B 69/3608 473/216 |
| 4,657,258 | A | * | 4/1987 | Melov | A63B 69/3667 473/272 |
| 5,050,885 | A | * | 9/1991 | Ballard | A63B 69/3623 434/252 |
| 5,072,942 | A | | 12/1991 | Hurley | |
| 5,083,789 | A | * | 1/1992 | Hickson | A63B 69/3667 473/272 |
| 5,439,225 | A | | 8/1995 | Gvoich et al. | |
| 5,467,993 | A | | 11/1995 | Higginson | |
| 5,895,327 | A | * | 4/1999 | Francisco | A63B 69/3644 473/229 |
| 5,984,798 | A | | 11/1999 | Gilmour | |
| 7,056,224 | B1 | * | 6/2006 | Keyes | A63B 69/3641 473/229 |
| 7,144,340 | B1 | | 12/2006 | Jones et al. | |
| 7,238,116 | B1 | | 7/2007 | Sulzener | |
| 7,670,233 | B2 | | 3/2010 | Jones | |
| 7,846,035 | B2 | | 12/2010 | Bailey | |
| 7,862,444 | B2 | | 1/2011 | Jones | |
| 2008/0153618 | A1 | | 6/2008 | Arther | |
| 2014/0011602 | A1 | * | 1/2014 | Zimmerman, II | A63B 69/3644 473/259 |

FOREIGN PATENT DOCUMENTS

| | | |
|---|---|---|
| GB | 2099312 | 12/1982 |
| GB | 2347630 | 9/2000 |
| KR | 848470 | 7/2008 |
| WO | WO2005005002 | 1/2005 |
| WO | WO2006065229 | 6/2006 |

* cited by examiner

SECTIONA-A

SECTION B-B

ITEMS 2,4,7 OMITTED
FOR CLARITY

SECTION C-C
ITEMS 3,5,6 OMITTED
FOR CLARITY

ITEMS 3,5,6,7 OMITTED
FOR CLARITY

SPORTS TRAINING AND CONDITIONING APPARATUS RELATING TO GOLF

CROSS-REFERENCE TO RELATED APPLICATIONS

This application, under 35 U.S.C. §119, claims the benefit of U.S. Provisional Patent Application Ser. No. 62/057,673 filed on Sep. 30, 2014, and titled "You Perfect Golf Swing Training Apparatus And Method," the contents of which are hereby incorporated by reference herein.

FIELD OF THE DISCLOSURE

This disclosure relates to systems and methods for training a user to perform a proper swing in sports and activities where the swinging of an arm, club, bat, racket, or the like is part of the sport or activity.

BACKGROUND

Golf continues to grow in popularity around the world. The principal limitations on its growth have been the time and expense required to play coupled with the frustration for most in not realizing meaningful improvements. We spend an immense amount of time and money playing and practicing, often with professional instruction, and on ball and equipment purchases, all in search of a better game. Nonetheless, most of us continue to play at a fairly mediocre level. Even top professionals struggle with swing inconsistencies and breakdowns, frequently coupled with physical deterioration that limits or prevents play. We have come to accept the notion that "golf is not a game of perfect" and many have given up altogether.

Modern instructional technology has greatly improved the ability to identify and correct swing errors. However, nothing developed so far comes close to providing immediate and continuous feedback to produce a sound, repeatable swing. Also, many golfers engage in physical conditioning with stretching and weight lifting intended to strengthen the body for distance, accuracy and injury prevention. Nonetheless, injuries frequently do develop, and distance, accuracy and level of play suffer, due to inefficient or counter-productive exercise and swings.

A perfect swing can be seen as one made in a perfect circle on a single plane around a stable center pivot point. It is optimally efficient, repeatable, biomechanically functional and precise, and delivers perfect results. Over the years, many players have swung on two planes, where there is a plane shift at the top of the backswing, typically with the arms and hands dropping to a somewhat lower position before the downswing is initiated, so that the single plane of the downswing and follow-through is different and not parallel to that of the backswing. Dual-plane swings allow more opportunity for error, in the top-of-backswing transitioning between planes. Bio-mechanically, the single-plane swing is easier on your body, because the swing load through impact is released on the same track on which the coil was made so is carried more uniformly along your entire spine from bottom to top. For these reasons, most players today with dual-plane swings minimize the degree of plane shift at the transition between backswing and downswing/follow-through.

The above issues, inconveniences, and drawbacks are merely exemplary. Other drawbacks with existing systems and methods also exist.

SUMMARY

Accordingly, the presently disclosed systems and methods address the above-noted, and other, drawbacks of existing systems and methods. Disclosed embodiments include an apparatus and method for implementing a golf swing training and physical conditioning apparatus in which you make exactly the swing you want every time; you swing the club with properly synchronized body rotation around a stable spine on a circular single plane from start to finish and with precise position through impact. As referred to herein, the apparatus and method are called "Your Perfect Golf Swing" and abbreviated as "YPGS."

Embodiments of YPGS are easily adjustable from person to person. YPGS drills muscle memory of a perfect swing and in the process ingrains a clear understanding of what makes it perfect.

As noted above, a typical perfect swing is one made in a circle on a single plane around a stable center pivot point. It is optimally efficient, repeatable, biomechanically functional and precise, and delivers perfect or near perfect results.

In most cases, the center point of the swing is the swing fulcrum, the lever or pivot point of the swing, from which the most leverage is generated to produce the maximum amount of outwardly radiating force at impact. That swing center or fulcrum is located at the intersection on the spine of a straight-line extension of the club shaft extending from the ball at address. The steeper the swing, the higher up the spine it is located. That swing center point or fulcrum never moves throughout the entire swing. That imaginary straight line extending from fulcrum through extended arms to hands is the fulcrum-hands swing radius whose length remains constant throughout the swing, as when set at address, like a spoke on a wheel. For right-handed golfers, a straight left arm assures constancy of length of the fulcrum-hands radius during the right side of the swing, from address through the backswing and downswing and into impact. At that point, the right arm takes over from the left. The left arm begins to fold inward and the right arm fully extends and remains straight well into the follow-through. This assures the constancy of length of this radius during the left side of the swing. The backswing, downswing and follow-through all stay on exactly the same plane. Naturally, for left-handed golfers the above-described actions of the left and right arms are reversed.

Typically, the spine must remain stable from top to bottom in order to allow the club shaft to rotate around it on a single plane, with rotation of the torso synchronized with legs, arms and hands. The spine is effectively the stable axis of the swing, spinning or rotating freely within the limits of trunk rotation, clockwise and counter-clockwise. The lateral (left to right) and anterior (back to front) spine tilts, together with the vertical position in space of the spinal axis, are set at address and do not move in any direction at any point in the swing. Maintaining spine stability, often referred to as "maintaining spine angle," is one key to a consistently repeating swing on plane.

In the following, a right-handed swing is described, but the same principles apply to a left-handed swing with the right and left actions reversed. Each side of the swing can be seen as a semi-circular loop around a stationary spine, to the right on the backswing/downswing and to the left in the follow-through. In the backswing, the trunk rotates around the stable spine away from the ball to the right, typically in a full swing to a position at the top where the back is facing the target with most of the body weight against the right side.

In the downswing and follow-through, the trunk rotates around the spinal axis back to, around and through the address position. At finish of a full swing, most of the body weight is on the left side with the back facing away from the target. In fact, each side of a stable circular single-plane swing is virtually a mirror image of the other side.

Typically, the torso, legs, arms and hands all rotate together in synchronization in order to keep the spine stationary and the club shaft and clubface on plane throughout the swing with the correct clubface angle at and through impact for desired ball flight and trajectory.

Embodiments of the YPGS apparatus assure a synchronized single-plane, circular swing every time. Other advantages of the YPGS systems and methods also exist.

Figure 1:
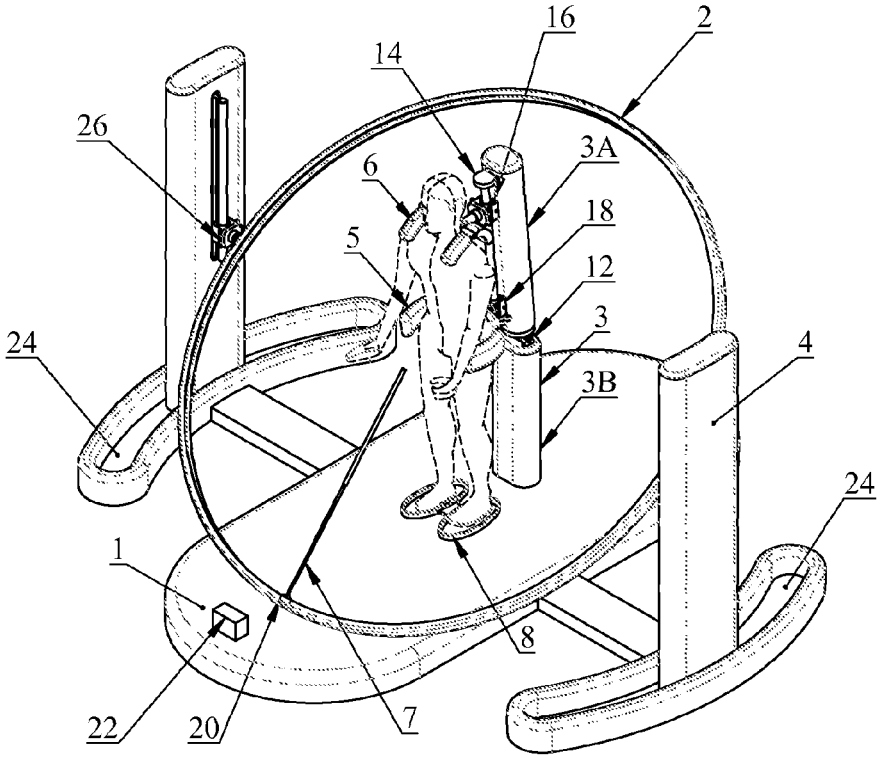
FIG. 1 is an isometric perspective front view of embodiments of the YPGS in accordance with the disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Figure 2:
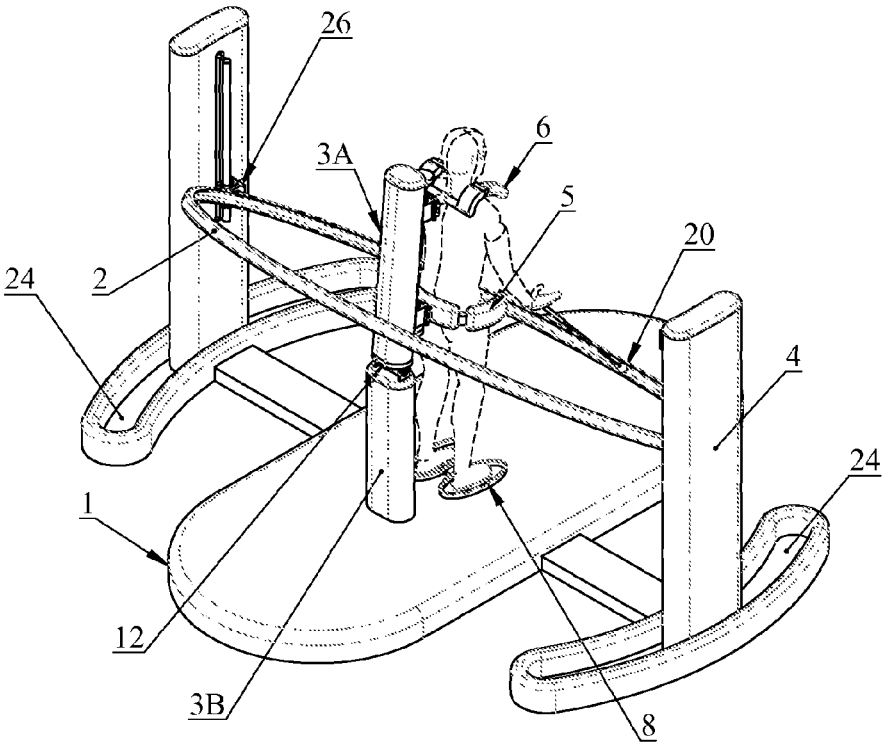
FIG. 2 is an isometric perspective rear view of embodiments of the YPGS in accordance with the disclosure.

FIG. 1 and FIG. 2 are isometric perspective front and rear views of embodiments of the YPGS in accordance with the disclosure. The integrated structure of embodiments exudes design efficiency, strength and precision as shown in YPGS apparatus 10. All mechanisms are connected to each other and mounted on a swing platform 1. A user takes a stance on the platform 1 inside foot receptacle 8. Embodiments of foot receptacle 8 are adjustable to accommodate any variety of a user's stance. For example, foot receptacles 8 may be movable to accommodate a wider or narrower stance, or may be movable back-to-front to accommodate a staggered stance, or the like. Embodiments of foot receptacle 8 may also include adjustable cuffing (not shown) that comfortably ratchets, buckles, straps or otherwise holds the feet generally in place, at the exact width, alignment relative to target, and restraint pressure and "play" desired. This helps develop the sensation of low body stability and properly synchronized leg action. In some embodiments, foot receptacle 8 may be fixed and the adjustable cuffing may be adjustable to accommodate varying stances. In other embodiments, both the foot receptacle 8 and the adjustable cuffing may be adjustable to accommodate varying stances and foot positioning.

Figure 6:
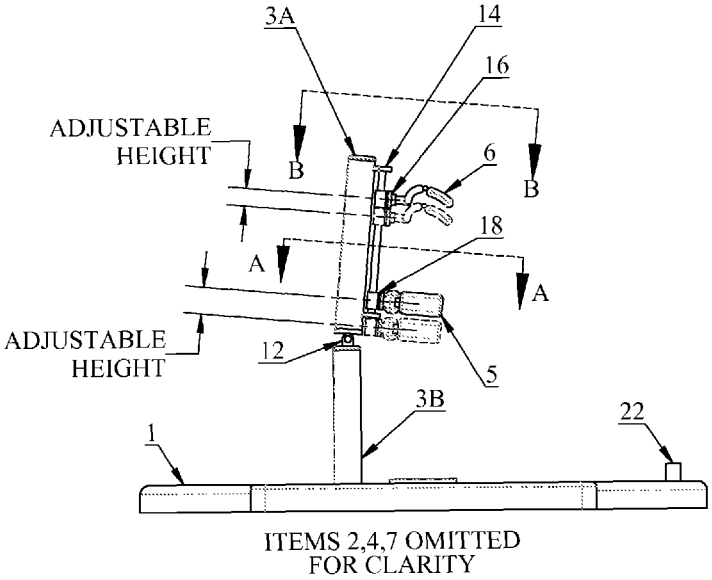
FIG. 6 is a side view of embodiments of the YPGS in accordance with the disclosure.

The user also fits his or her trunk into a torso stabilizer 3 that is some embodiments has an upper portion 3*a* and a lower portion 3*b* and a rotatable joint, hinge, gimbal, or the like 12, that allows the upper portion 3*a* to tilt and, in some embodiments rotate, with the user. The torso stabilizer 3 comprises a spinal axis 14 (e.g., best seen in FIG. 7) and shoulder 16 and hip 18 rotator bars. In some embodiments, the spinal axis 14 may be a solid rod or column positioned behind a user's back. Other configurations are also possible. The spinal axis 14 and stabilizer 3 enable stable back posture throughout the entire swing. In some embodiments, and as illustrated in FIG. 6, the user may adjust the orientation of the spinal axis 14 to whatever forward and lateral side-to-side tilts you want for desired swing steepness and ball trajectory. Once so adjusted, that spinal axis 14 keeps the user's torso stabilized throughout the swing while allowing rotation as indicated.

Figure 5:
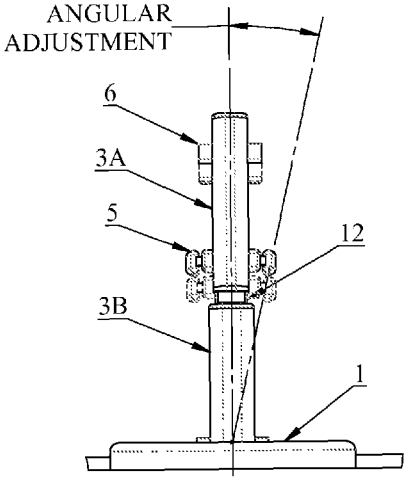
FIG. 5 is a partial rear view of embodiments of the YPGS in accordance with the disclosure.

In some embodiments, as illustrated in FIGS. 5-6, a user may adjust the locations of the shoulder 16 and hip 18 rotators up and down on the spinal axis 14 to fit the elevation of the user's hips and shoulders. The rotators 16, 18 are also hinged, gimbaled, or otherwise configured to rotate independently of each other around the spinal axis 14. The forward and lateral tilts of the shoulder 16 and hip 18 rotators are set as desired for address and typically do not change throughout the entire swing. Each rotator 16, 18 rotates on its own single plane at a relatively constant angle relative to the spinal axis 14 typically substantially perpendicular to it and substantially parallel to each other or otherwise.

Figure 3:
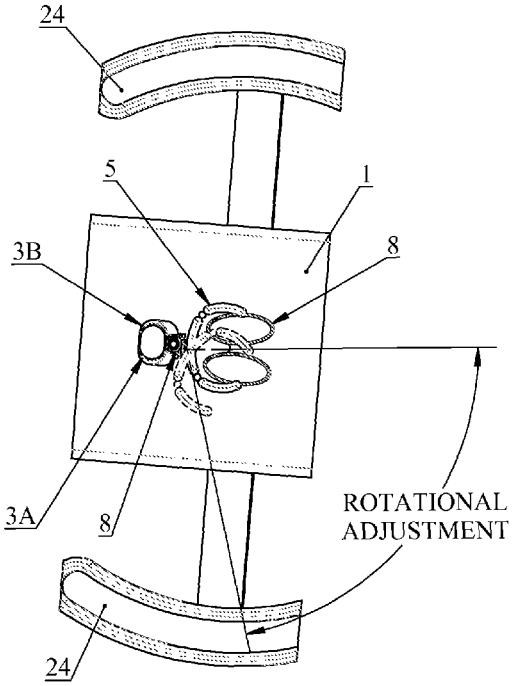
FIG. 3 is a cross-sectional view of embodiments of the YPGS along the line A-A in FIG. 6.
Figure 4:
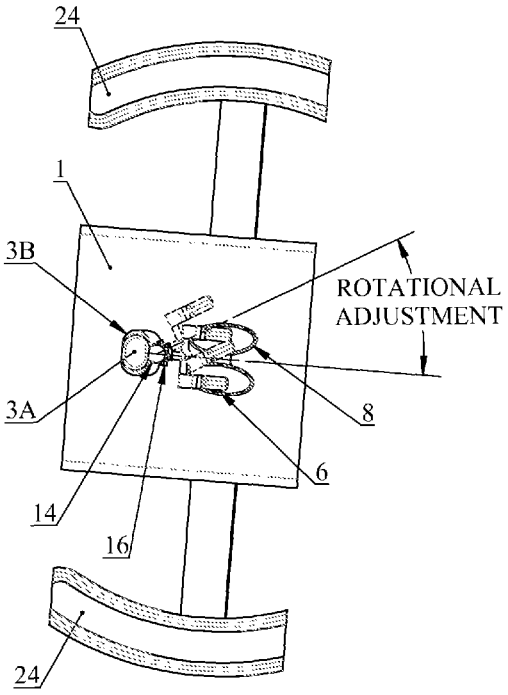
FIG. 4 is a cross-sectional view of embodiments of the YPGS along the line B-B in FIG. 6.

In some embodiments, a user's shoulders and hips fit snugly into adjustable harnesses 5, 6, affixed to the rotator bars 16, 18 that allow a user to rotate his or her trunk and swing smoothly and comfortably to any degree desired around the spine which is held relatively stationary in space. In such a manner, the user's spine does not substantially move laterally, forward-backwards, or up-down from its initial adjustments. As shown, embodiments of the hip rotator 18 partially cuffs around the user's pelvis and the base of the spine, creating a stable harness that almost floats the spine in place throughout the swing while allowing free hip rotation. Embodiments of the shoulder rotator 16 partially wraps or cuffs around the upper torso and shoulders, providing a secure fit while allowing free rotation of the shoulders and arms. As with the foot receptacle harness or strapping, the hip and shoulder harness 5, 6 could be formed like exoskeleton shells encasing air-inflatable or foam-injectable cushioned bladders or another type of pressurized clamping that seals a precise fit. As also illustrated in FIGS. 3-4, the hip and shoulder harnesses 5, 6 may be rotationally adjustable about the spinal axis 14. Both the vertical and rotational adjustments of the harnesses 5, 6 may be accomplished by implementation of bearings, hinges, gimbals, pivots, or the like. Other configurations are also possible.

Figure 7:
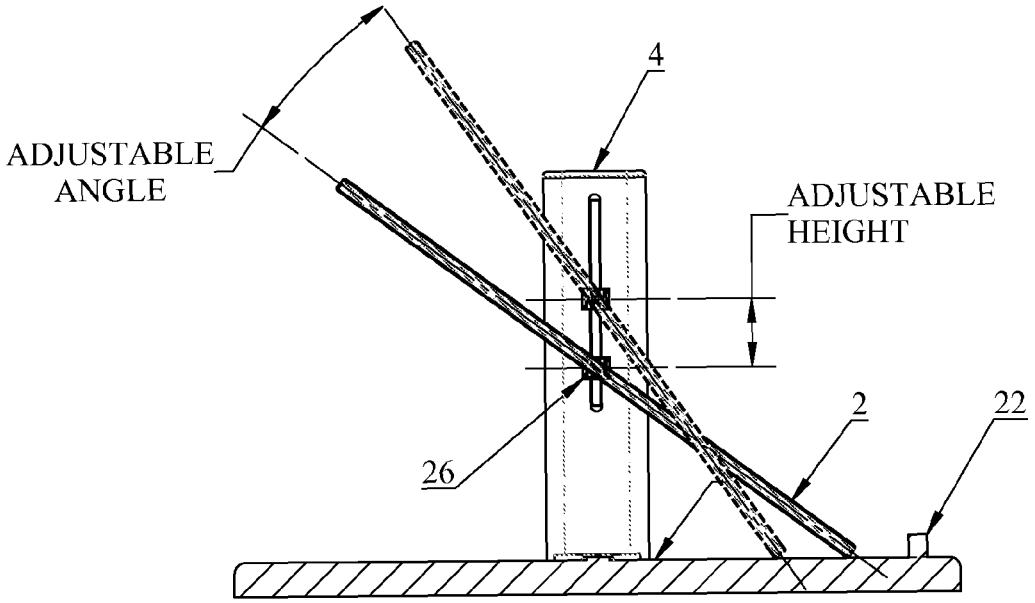
FIG. 7 is a cross-sectional view of embodiments of the YPGS along the line C-C in FIG. 8.
Figure 8:
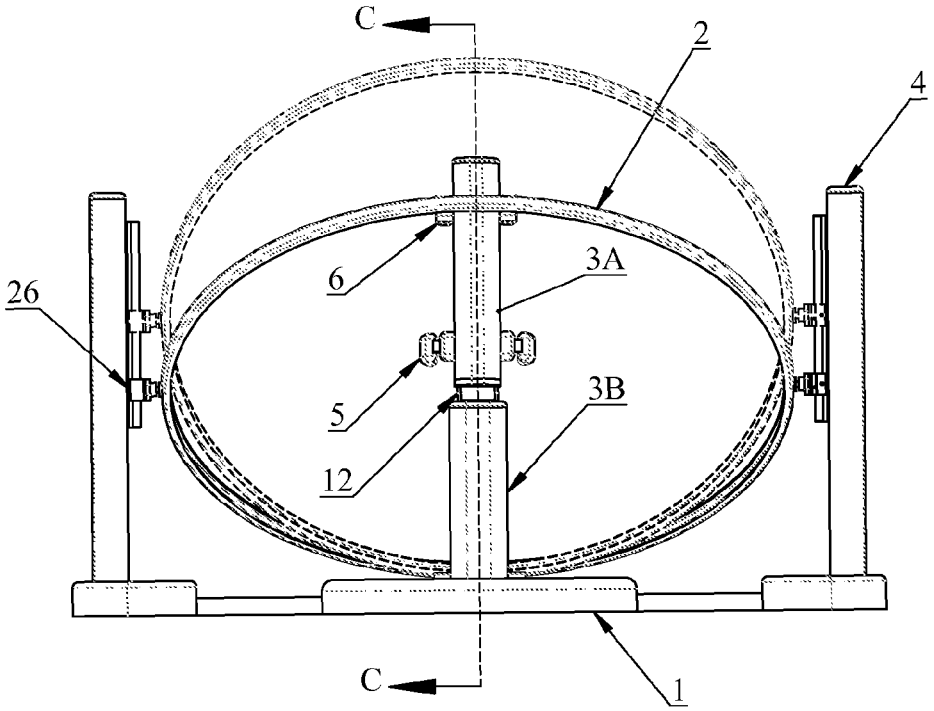
FIG. 8 is a rear view of embodiments of the YPGS in accordance with the disclosure.

In embodiments, the user may take a grip on a club shaft or handle 7 that runs from the hands to a single-plane, 360° circular swing channel or track 2 through which the user may swing the club 7. In some embodiments, the handle or grip 7 may be removable and replaceable or otherwise customizable to the user. In some embodiments, the shaft 7 remains connected to the channel 2 at all times when in use. In some embodiments, the channel 2 forms a substantially complete arc around and over the user. The user may adjust the height and tilts of the swing channel 2 consistent with the tilts of the spinal axis 14, i.e., forward to desired swing steepness and left-right/up-down for desired trajectory of ball flight. Possible adjustments are shown in FIGS. 7-8. As discussed above in connection with the rotators 16, 18, the adjustment of swing channel 2 may be accomplished by implementing the appropriate hinge, gimbal, pivot, or other adjustable clamping mechanisms 26 to position the and tilt the swing channel 2. For some embodiments, once the adjustments are made, they remain fixed throughout the entire swing, but can easily be changed as desired.

In some embodiments, the user's body's swing fulcrum is at the center of the swing channel 2. That imaginary straight line extending directly from the user's fulcrum to the channel 2 at any point in the swing is the swing channel radius. As the radius of a circle, its length remains constant throughout the swing (as does the length of the fulcrum-hands radius).

In some embodiments, the swing channel 2 may be constructed to be of a single diameter that is functional for all users. In this case, the length of the channel radius is the same for all users, but the distance from the hands to the channel at address, and hence the initial shaft length 7, varies from player to player depending on height and arm reach. That initial shaft 7 length is greater for shorter-reach players than it is for longer-reach players.

In some embodiments, the club/shaft 7 connects at the channel 2 into a channel slider or other mechanism 20 that rides up and down the channel 2 during the swing while continuously anchored to it, like a roller coaster on its tracking Embodiments of the channel slider may comprise bearings or the like that travel inside, outside, or on channel 2. In some embodiments, the club shaft 7 may comprise a telescoping shaft, extendable in length with coiling and uncoiling features. A telescoping shaft 7 could consist of an outer shaft encasing an extendible inner shaft that freely slides in and out of the outer during the swing, maintaining your continuous connection to the slider on the channel.

As the user swings, he or she effectively push-pulls the slider 20 through the channel 2. When the user start a backswing, he or she begins to drive the slider 20 up the channel 2 to the right. In the circular swing without any wrist cock, the distance from the hands to the channel 2 remains constant throughout the entire swing, as does the shaft 7 length, equal to that at address. In this case, the club shaft 7 is effectively the outer ray of the channel 2 radius throughout the entire swing. However, most swings do involve some measure of wrist cock. When wrist cock is initiated in the backswing, the club shaft 7 breaks off the imaginary line of the channel 2 radius and the shaft 7 begins to uncoil from itself, sliding out and lengthening as the channel slider 20 begins to move up the channel, automatically. As wrist cock increases, shaft 7 extension increases, and with shoulder rotation, the channel slider 20 travels higher up the channel 2 tracking The more wrist cock used at any point, the longer the shaft 7 extends. The club shaft 7 is extended to its longest by the top of the backswing where it has driven the slider 20 to its peak in the channel 2. In the downswing, the user swings the slider 20 downward through the channel 2, aided by gravity. As the user releases wrist cock in the downswing, the shaft 7 automatically retracts, sliding back to its shortest length at impact, essentially the same as at address. In the follow-through, the shaft 7 again extends as you swing the slider 20 up the channel 2. The more wrist cock, the longer the extension. Shaft 7 extension is again at its longest by swing finish, where you have driven the slider 20 to its peak.

In embodiments of the YPGS, the telescoping club shaft 7 automatically rotates open and closed as it extends and retracts through the swing. Mechanically, shaft 7 rotation can occur in some embodiments with an inner shaft that rotates freely inside a non-rotating outer shaft attached to the channel slider 20. Alternatively, both shafts 7 can be aligned together and connect into a circular rotating ring or similar device contained in the channel slider 20. In this case, as you drive the slider 20 through the channel 2 with wrist cock and shoulder rotation, the two shafts 7 rotate together inside the ring mechanism. Either way, the shaft 7 rotates open (clockwise) typically from a squared/neutral position at address to its most open position at the top and closing (counter-clockwise) in the downswing through impact and follow-through to its most closed rotation at the finish. Other club face positions can also be used.

Embodiments of the YPGS have a built-in swing speed monitor 22 that helps the user to learn to optimize rhythm and timing and synchronized rotation of hips, shoulders, arms, hands and legs, in order to achieve maximum acceleration on plane through impact. In some embodiments the monitor 22 may be located in platform 1 as indicated. In other embodiments, other locations for monitor 22 may be implemented such as a display on shaft 7 or swing channel 2 or the like. In other embodiments, additional add-ons like speed monitor 22 could include mirroring and ball flight simulators, or other swing measurement devices. Likewise, other embodiments of YPGS could involve a full-length shaft 7 with ball impact. Other variations are also possible.

In embodiments of the YPGS implemented to build a user's strength and flexibility and to improve rhythm, speed and control, the rotators 16, 18, club shaft 7 and channel slider 20 may be weighted and/or equipped with adjustable resistance applied in the takeaway/backswing and also in the downswing and follow-through. For example, springs, weights, torsion devices, or other resistance devices can be incorporated into any of the support columns 4, torso support 3, swing channel 2, slider 20, or shaft 7 to add resistance to the swing.

Figure 9:
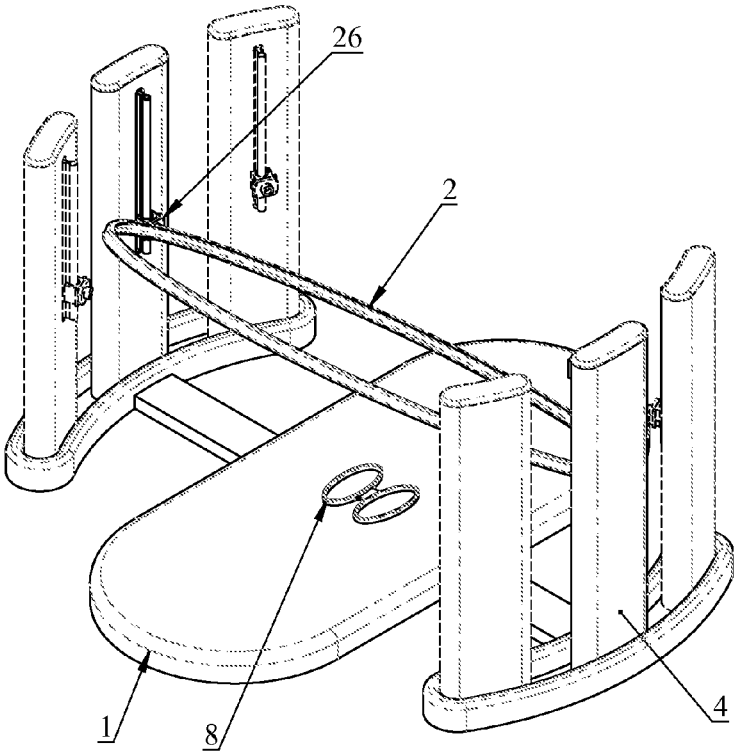
FIG. 9 is an isometric perspective view of embodiments of the YPGS in accordance with the disclosure.
Figure 10:
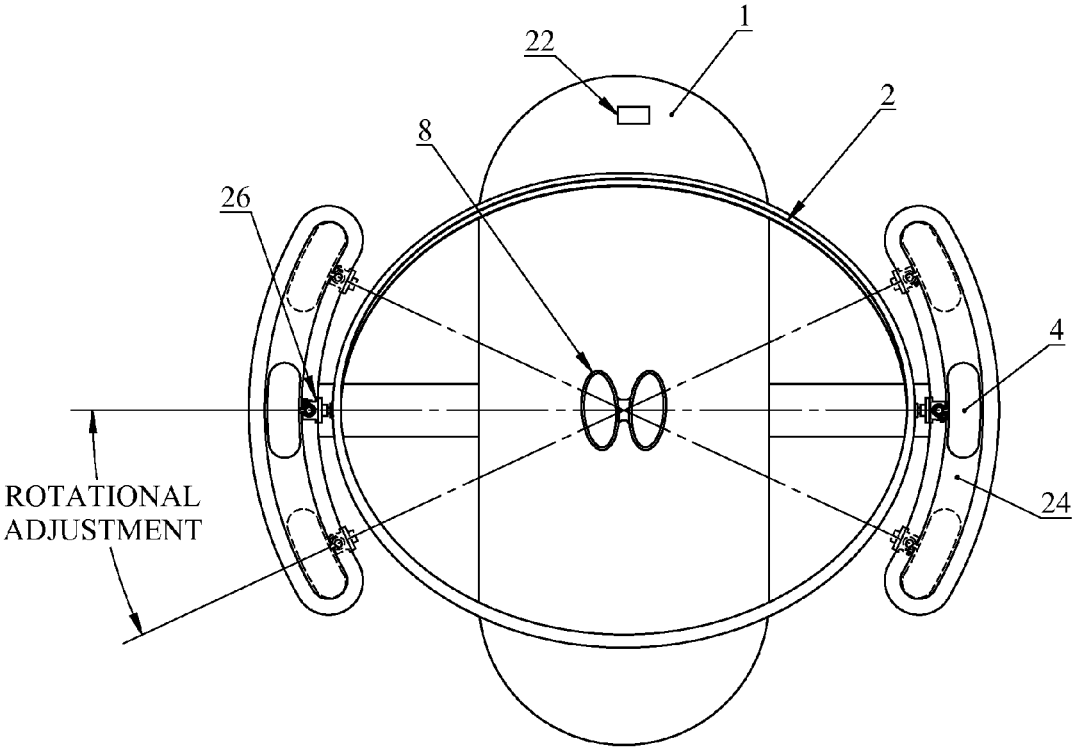
FIG. 10 is a top-down view of embodiments of the YPGS in accordance with the disclosure.

As shown in FIGS. 9-10, embodiments of the YPGS may enable rotational adjustment of the apparatus by allowing support columns 4 to be positioned in support bases 24. Support columns 4 may be adjustable by implementing bearings, tracks, wheels, clamps, or the like, to allow the columns 4 to be moved and positioned in bases 24. Other configurations are also possible.

In addition to the embodiments described above, embodiments of the YPGS may be used as core or spine trainers for fitness, rehabilitation, or training independent of any particular sport or activity. For example, the core movement of virtually every sport has a single fulcrum point of stability and power. The location of that point is virtually identical between many sports, including swings of golf, baseball, tennis and hockey and throws of baseball and football, discus, javelin, shot put and hammer throw. The above described YPGS core principles of synchronized body rotation on a single plane around a stable axis apply to many sports involving swinging, throwing, punching and kicking YPGS can be adapted to train proper mechanics of these sports, such as for baseball and tennis swings. In addition, YPGS can be used as a fitness station for healthy, injured and physically disabled people alike.

Although various embodiments have been shown and described, the present disclosure is not so limited and will be understood to include all such modifications and variations are would be apparent to one skilled in the art.

What is claimed is:

1. A training apparatus comprising:

a torso stabilizer wherein the torso stabilizer further comprises:

an upper portion;

a lower portion; and a joint in between the upper portion and the lower portion that enables the upper potion to tilt;

a spinal axis located at least in part on the upper portion of the torso stabilizer;

a shoulder rotator located at least in part on the spinal axis;

a hip rotator located at least in part on the spinal axis; and wherein the shoulder rotator and hip rotator rotate about the spinal axis;

a swing channel;

a shaft; and wherein the shaft is connected to the swing channel in a manner that enables a user to practice a swing with the shaft thereby causing the shaft to travel in a path defined by the swing channel.

2. The apparatus of claim 1 further comprising:

a channel slider connected to the shaft and configured to travel along the swing channel.

3. The apparatus of claim 2 wherein the channel slider travels within the swing channel.

4. The apparatus of claim 2 wherein the channel slider travels around an outside perimeter of the swing channel.

5. The apparatus of claim 1 wherein the shoulder rotator and hip rotator rotate about the spinal axis independently of one another.

6. The apparatus of claim 1 further comprising:

a shoulder harness connected to the shoulder rotator; and a hip harness connected to the hip rotator.

7. The apparatus of claim 1 wherein at least one of the shoulder rotator and the hip rotator are adjustable in position along the spinal axis.

8. The apparatus of claim 7 wherein the swing channel is adjustable in height from the ground upon which the training apparatus is positioned.

9. The apparatus of claim 7 wherein the swing channel is adjustable in angular position.

10. The apparatus of claim 9 wherein the shaft is an adjustable telescoping shaft.

11. The apparatus of claim 1 wherein the swing channel is adjustable.

12. The apparatus of claim 1 wherein the shaft is adjustable in length.

13. The apparatus of claim 1 wherein the shaft is rotatable.

14. The apparatus of claim 1 further comprising a foot receptacle.

15. The apparatus of claim 14 wherein the foot receptacle is adjustable in position with respect to the torso stabilizer.

16. The apparatus of claim 14 wherein the foot receptacle comprises adjustable foot restraints that releasabley secure a user's foot in place.

17. The apparatus of claim 1 further comprising adjustable resistance that enables a user to adjust the resistance associated with the rotation of the user's body and travel of the shaft in the path defined by the swing channel.

18. The apparatus of claim 1 further comprising a swing monitor capable of determining a characteristic of the swing.

* * * * *